US005336969A

United States Patent [19]

Weiss et al.

[11] Patent Number: 5,336,969

[45] Date of Patent: Aug. 9, 1994

[54] HIGHLY THERMALLY LOADED ELECTRIC LAMP WITH REDUCED UV LIGHT EMISSION, AND METHOD OF ITS MANUFACTURE

[75] Inventors: Werner Weiss, Stadtbergen; Manfred Deisenhofer, Unterschoeneberg, both of Fed. Rep. of Germany

[73] Assignee: Patent-Treuhand-Gesellschaft Fuer Elektrische Gluehlampen MBH, Munich, Fed. Rep. of Germany

[21] Appl. No.: 895,945

[22] Filed: Jun. 9, 1992

[30] Foreign Application Priority Data

Jun. 24, 1991 [DE] Fed. Rep. of Germany ..... 4120797

[51] Int. Cl.[5] ..... H01K 1/26

[52] U.S. Cl. ..... 313/580; 313/112; 313/489; 313/579; 427/106

[58] Field of Search ..... 313/110, 112, 489, 579, 313/634, 635, 580; 427/106, 126.4, 107; 501/57

[56] References Cited

U.S. PATENT DOCUMENTS 2,974,052 7/1960 Bacon et al. ..... 106/52
3,148,300 8/1961 Graff ..... 313/221
3,531,677 9/1970 Loughridge ..... 313/112
5,214,345 5/1993 Saito et al. ..... 313/635

FOREIGN PATENT DOCUMENTS 63213253 9/1988 Japan .

*Primary Examiner*—Donald J. Yusko
*Assistant Examiner*—Vip Patel
*Attorney, Agent, or Firm*—Frishauf, Holtz, Goodman & Woodward

[57] ABSTRACT

To reduce the transmissivity of glass, and particularly quartz glass, especially highly thermally loaded quartz glass of discharge lamps or halogen incandescent lamps, a coating or glaze is applied to the bulb and adjacent regions which includes, as an ultraviolet light absorption, a glaze of a mixture of cerium fluoride ($CeF_3$) and aluminum trioxide ($Al_2O_3$) and silicon dioxide ($SiO_2$), in a relationship, by weight, of about 3:1, preferably about 2:1. The weight relationship of $Al_2O_3$ to $SiO_2$ in the mixture is about 1.7:1. The mixture can be applied in form of an alcohol or alcohol-like suspension, after grinding to a grain size of less than 300 mesh, by spraying, dripping on, painting or the like, subsequent drying for 10 seconds, and firing in a hydrogen/oxygen flame or in an ordinary gas flame for about 2 seconds, while axially rotating the lamp bulb.

16 Claims, 3 Drawing Sheets

HIGHLY THERMALLY LOADED ELECTRIC LAMP WITH REDUCED UV LIGHT EMISSION, AND METHOD OF ITS MANUFACTURE

FIELD OF THE INVENTION

The present invention relates to suppression of transmission of ultraviolet (UV) light through a glass layer, and more particularly to a glaze or coating on a quartz glass bulb of an electric lamp, which, in operation, becomes very hot.

BACKGROUND

High-pressure discharge lamps as well as highly loaded halogen incandescent lamps generate a relatively high proportion of UV radiation when the lamps operate. The lamp bulbs are made of quartz glass due the high thermal loading placed on the bulb. Quartz glass has a high degree of transparency for UV radiation in the range of between 400 nm to 200 nm. For many applications, the energy-rich UV radiation is undesirable, and may be harmful. UV radiation, in excess, has undesirable biological effects and, additionally, causes plastics and plastic components to become brittle. It is therefore necessary to reduce the transparency of the lamp bulb to UV radiation unless the lamps have an outer covering envelope which absorbs UV radiation.

The referenced U.S. Pat. No. 3,531,677, Loughridge, describes a high-pressure discharge lamp having a discharge vessel made of quartz glass. It is furnished with a UV absorbing coating or glaze. The UV absorbing coating is made of a eutectic mixture of $Al_2O_3$ and $SiO_2$. The eutectic coating is doped with between 0.05% to 10% of UV absorbing substances, for example $TiO_2$ or $CeO_2$.

The coating is made by providing a suspension of the $Al_2O_3 \cdot SiO_2$ mixture and the UV absorbing substance, that is, either $TiO_2$ or $CeO_2$, in isopropyl alcohol with water. This suspension is sprayed on the bulb, dried, and then fired so that a glaze will result. It has been found that the UV transparency of such lamps is not reduced to a currently desired extent by the UV absorbing coating. The manufacturing process to so coat these bulbs, particularly drying and firing of the coating, is comparatively time-consuming and thus expensive for mass-produced lamp bulbs.

It has also been proposed to dope quartz glass directly when the glass is used for lamp bulbs, by doping the quartz glass with UV absorbing ions. This results in a reduction of the viscosity of the quartz glass, so that the thermal loading which can be placed on a quartz glass is reduced; this reduction also reduces the light output available from the lamp.

THE INVENTION

It is an object to reduce the UV transparency of glass, and specifically quartz glass bulbs used in connection with electric lamps, to a high degree, without, however, reducing the transparency of the glass in the visible spectral region.

Briefly, a UV absorbing coating which comprises a glaze including cerium fluoride ($CeF_3$) and a mixture of aluminum trioxide, or $Al_2O_3$ and silicon dioxide, a $SiO_2$-($Al_2O_3 \cdot SiO_2$) is applied to the glass.

The degree of transmission of the lamp bulb in accordance with the present invention with respect to UV radiation is substantially decreased already in layer thicknesses of only a few micrometers. It has been found that coatings with cerium fluoride ($CeF_3$), under otherwise equal conditions, have a higher UV absorbing effect than coatings with $CeO_2$. $CeF_3$ has a specific advantage with respect to the UV absorbing material titanium dioxide, $TiO_2$, in that $CeF_3$ also absorbs long-wave UV radiation; $TiO_2$ absorbs primarily short-wave UV radiation.

The coating of $CeF_3$ in accordance with the present invention does not decrease the transparency of the glass, that is, the lamp bulb, if the coatings are not too thick with respect to visible light. The process of manufacture can be carried out in much shorter time than in accordance with the prior art. The lamps have another unexpected advantage in that the tendency of quartz molecules to vaporize from the lamp bulb when placed in a moist or damp atmosphere, which results in roughening of the surface of the lamp bulb, is reduced by the coating.

In accordance with a feature of the invention, a suspension of $CeF_3$ and $Al_2O_3 \cdot SiO_2$ is formed in a suitable solvent, e.g. an alcohol. The suspension is then ground, so that the grain size is small, the suspension is thinned in a thinner, and then applied to the surface of the quartz glass bulb. The bulb is then dried, the bulb is heated to about 400° C., and then fired to form the glaze. Preferably, the proportion of $CeF_3$ to $Al_2O_3 \cdot SiO_2$ is between about 1:1 and 3:1, especially about 2:1.

All proportions given in the specification and claims, unless otherwise noted, are by weight.

DRAWINGS

FIG. 1 illustrates, highly schematically, a high-pressure discharge lamp having a coating in accordance with the present invention;

FIG. 1*a* is a highly schematic view of a double-ended halogen incandescent lamp, having the coating of the present invention; and FIG. 2 is a graph of light transmissivity, both within the UV and visible range, of the lamp bulb of FIGS. 1 and 1*a* (ordinate) with respect to wave length (abscissa), wherein curve 2 shows the transmissivity with the coating and curve 1 the transmissivity without the coating, in accordance with the prior art.

DETAILED DESCRIPTION

Figure 1:
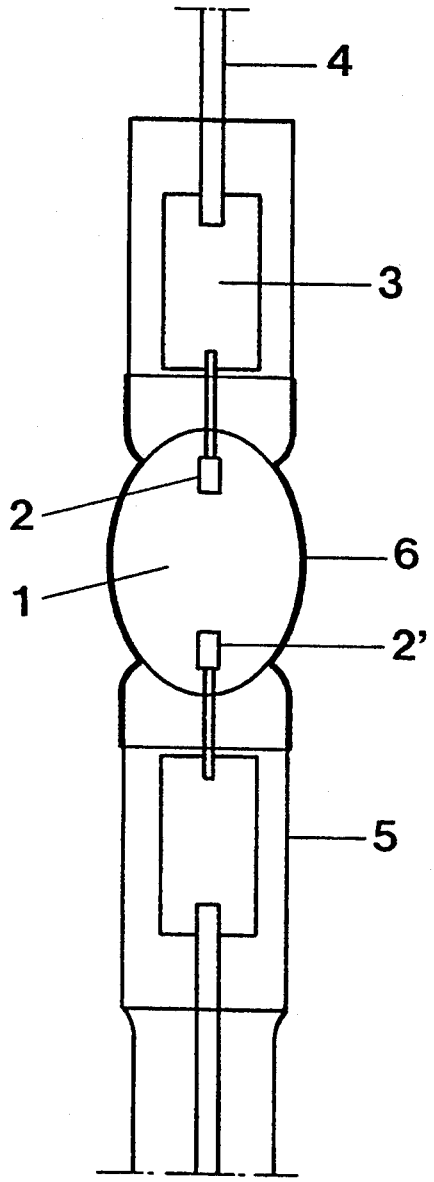
Figure 1A:
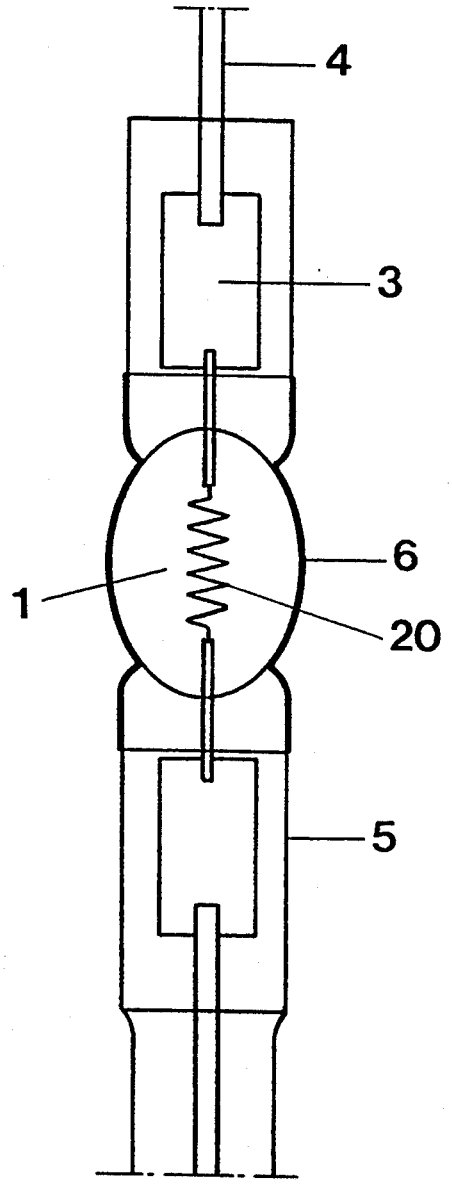

Referring first to FIGS. 1 and 1*a*:

FIG. 1 illustrates a metal-halide high-pressure discharge lamp, for example suitable for incorporation in an automotive vehicle headlight. The lamp has a discharge vessel 1 of quartz glass, in which two electrodes 2, 2' are located. The electrodes, each, are connected via a molybdenum foil 3, pinch-sealed in a pinch seal 5 to external electrical connecting leads 4. The discharge vessel 1 is held in position in a plastic base—not shown—fitted to the pinch seals 5. The plastic base might, absent the present invention, be rendered brittle and, in due course, would fail due to the exposure to UV radiation, transmitted through the quartz glass vessel 1. This UV radiation is of high energy. Failure of the lamp base, of course, would lead to complete failure of the overall lamp—base unit or combination.

FIG. 1*a* shows a lamp, which in all respects can be similar to the lamp of FIG. 1, except that the discharge electrodes 2, 2' are replaced by a filament 20. Of course, the lamp could as well be a single-based, single-ended lamp.

In accordance with the present invention, the discharge vessel 1 is supplied with an external coating 6 of $CeF_3$ and $Al_2O_3 \cdot SiO_2$. This coating 6 has a thickness of, preferably, between about 5 to 10 μm, which substantially decreases the transmissivity of the discharge vessel 1 with respect to UV radiation. The thickness of the coating 6 is optimized with respect to transparency to visible radiation while still substantially decreasing the transmission of UV radiation.

The coating 6 of $CeF_3$ with $Al_2O_3 \cdot SiO_3$ extends from the discharge vessel 1, itself, to the immediately adjacent regions of the seals 5, which are also subjected to a high thermal loading. This is done to, also, reduce the evaporation or vaporization of quartz molecules from the highly heated surface of the discharge vessel 1 and the immediately adjacent regions of the necks 5 extending from the discharge surface 1.

The relationship, by weight, of cerium fluoride, $CeF_3$, to $Al_2O_3 \cdot SiO_2$ in the coating 6 is 2:1. The relationship of $Al_2O_3$ to $SiO_2$ in the $Al_2O_3 \cdot SiO_2$ mixture is approximately 1.7:1. The presence of $Al_2O_3$ in the coating 6 increases the solubility of the $CeF_3$, which absorbs the UV radiation, in the quartz melt to such an extent that sufficient UV absorption will be obtained in the coating 6.

Figure 2:
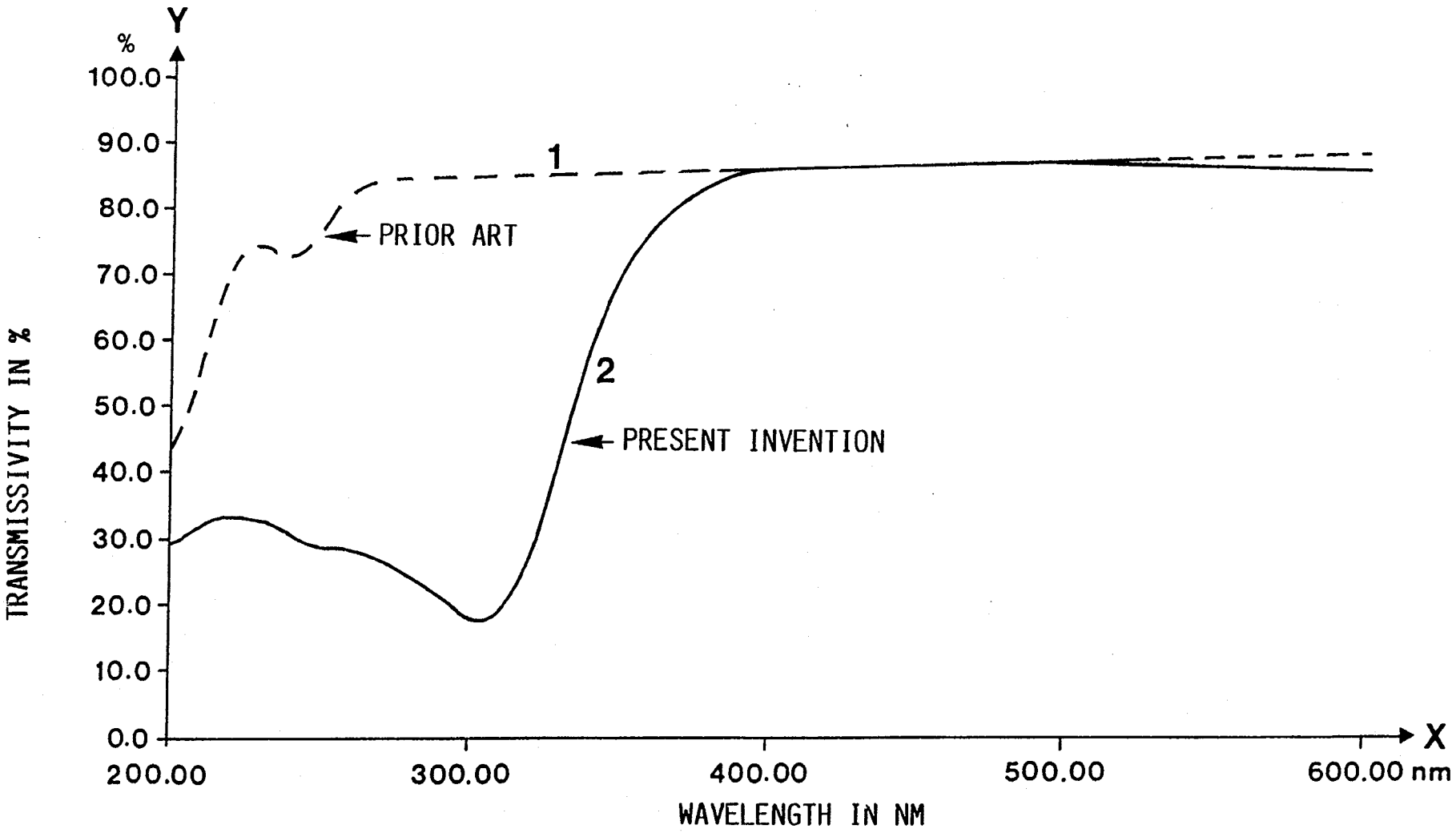

FIG. 2 graphically illustrates the comparison of transmissivity of a quartz glass bulb for UV radiation as well as visible light of a bulb in accordance with the present invention with respect to the prior art, that is, without coating. The coating 6 in FIG. 2 is the coating $CeF_3 + Al_2O_3 \cdot SiO_2$ having a thickness of approximately between 5 to 10 μm. Transmissivity of 100% means that all light generated within the lamp bulb at the respective wave length is transmitted through the light bulb.

A comparison of the curve 2 of the present invention with respect to the curve 1 of the prior art, or uncoated bulb, clearly shows a substantially increased UV absorption and attenuation of UV transmission; light within a visible spectral range of from about 400 nm to 600 nm is hardly attenuated by the coating 6.

In accordance with a feature of the invention, the coating 6 is preferably applied to the finished quartz glass bulb. A suspension of cerium fluoride, $CeF_3$, and $Al_2O_3 \cdot SiO_2$ mixture in alcohol is provided. The relationship, by weight, of $CeF_3$ to $Al_2O_3 \cdot SiO_2$ is approximately 2:1. The weight relationship between $Al_2O_3$ to $SiO_2$ in the mix is approximately 1.7:1.

The mixture is mixed in a ball mill, under addition of alcohol, until a grain size of the mixture of less than 300 mesh is obtained. Thereafter, additional alcohol is added and the suspension is thinned approximately in the relationship of 1:5. The finished suspension is dripped on the lamp bulb while the lamp bulb is rotated. Alternatively, it can be sprayed on the bulb or painted on it by a brush or brush arrangement. The bulb is then dried at a temperature of about 400° C., for about 10 seconds. At that step, the coated portion of the lamp bulb will appear slightly yellowish. This permits an optical inspection of the coating. Thereafter, the coating is fired in an $H_2/O_2$ flame, or in an ordinary utility-supplied gas flame—air—$O_2$ flame, while rotating the lamp bulb. This fires the coating. Firing of the coating takes about 2 seconds. After coating, the coated portion of the lamp bulb will appear clear or slightly silky or frosted, in dependence on the thickness of the layer.

Rather than using spirit or alcohol, nitrocellulose may be used as a binder as an additive after grinding in the ball mill. To make the binder, 5% butylacetate-nitrocellulose is thinned with 7 times the quantity of spirit or alcohol. 4–6 parts of this binder, rather than the pure spirit or alcohol, are added to the suspension in the ball mill as a modification of the above-described manufacturing process. Other thinners than spirit or alcohol may be used, such as acetone or butylacetate.

The coating can be applied to any type of lamp, and especially to lamps having quartz glass bulbs which are highly thermally loaded. The coating in accordance with the present invention is particularly suitable on bulbs of high-pressure discharge lamps which do not have an outer envelope or cover, as well as with highly loaded halogen incandescent lamps. Such lamps are used in the photographic and optical fields.

We claim:

1. Electric lamp having a bulb (1) of quartz glass;
light emitting means (2, 2', 20) within said bulb, said light emitting means, in operation, generating heat; and
an ultraviolet (UV) absorbing coating (6) on the quartz glass,
wherein, in accordance with the invention,
the UV absorbing coating (6) comprises a glaze which includes, as a major or equal constituent, cerium fluoride ($CeF_3$) and, as an equal or minor constituent, a mixture of aluminum trioxide, ($Al_2O_3$) and silicon dioxide ($SiO_2$) ($Al_2O_3 \cdot SiO_2$).

2. The lamp of claim 1, wherein the relationship, by weight, of $CeF_3$ to $Al_2O_3 \cdot SiO_2$ in the coating (6) is between 1:1 and 3:1.

3. The lamp of claim 2, wherein the relationship, by weight, of the aluminum trioxide ($Al_2O_3$) to the silicon dioxide ($SiO_2$), is approximately 1.7:1.

4. The lamp of claim 1, wherein the relationship, by weight, of $CeF_3$ to $Al_2O_3 \cdot SiO_2$ in the coating (6) is about 2:1.

5. The lamp of claim 4, wherein the relationship, by weight, of the aluminum trioxide ($Al_2O_3$) to the silicon dioxide ($SiO_2$), is approximately 1.7:1.

6. The lamp of claim 1, wherein (FIG. 1) the lamp is a high-pressure discharge lamp, having a discharge vessel (1) comprising quartz glass, and the coating is applied to the bulb at the outer surface thereof.

7. The lamp of claim 6, wherein said lamp has neck portions (5) extending from the bulb;
and said coating extends over at least part of said neck portions.

8. The lamp of claim 1, wherein (FIG. 1*a*) the lamp is a halogen incandescent lamp, and the bulb (1) comprises quartz glass and the coating is supplied to the outer surface of the quartz glass.

9. The lamp of claim 8, wherein said lamp has neck portions (5) extending from the bulb;
and said coating extends over at least part of said neck portions.

10. A method to make an electric lamp as claimed in claim 1, said method comprising the following steps:
providing a lamp bulb;
providing a suspension which comprises $CeF_3$ and $Al_2O_3 \cdot SiO_2$ in a thinner, in which the relationship, by weight, of $CeF_3$ to $Al_2O_3 \cdot SiO_2$ is between about 1:1 and 3:1;
milling the suspension to obtain a grain size of the solid substances in the suspension which is smaller than 300 mesh;
thinning the suspension with an additional thinner;
applying the suspension to a surface of the glass bulb;
drying the coating;

heating the glass bulb to about 400° C.; and firing the coating to form a glaze.

11. The method of claim 10, wherein the relationship, by weight, of the aluminum trioxide ($Al_2O_3$) to the silicon dioxide ($SiO_2$), is approximately 1.7:1.

12. The method of claim 10, wherein the relationship, by weight, of $CeF_3$ to $Al_2O_3 \cdot SiO_2$ is about 2:1.

13. The method of claim 10, including the step of adding a binder to the suspension after the milling step.

14. The method of claim 13, wherein said binder includes approximately 5% butylacetate-nitrocellulose, thinned with alcohol, and the additional thinner comprises alcohol or spirit.

15. The lamp of claim 1, wherein said UV absorbing coating has a thickness of between about 0.005 and 0.01 mm.

16. The lamp of claim 1, wherein the relationship, by weight, of the aluminum trioxide ($Al_2O_3$) to the silicon dioxide ($SiO_2$), is approximately 1.7:1.

* * * * *